US006918589B2

(12) United States Patent
Thibault

(10) Patent No.: US 6,918,589 B2
(45) Date of Patent: Jul. 19, 2005

(54) WINNING SCHEME FOR A LOTTERY TYPE GAME

(75) Inventor: Harold Thibault, Montreal (CA)

(73) Assignee: Ingenio, Filiale de Loto-Québec Inc., Quebec (CA)

( * ) Notice: Subject to any disclaimer, the term of this patent is extended or adjusted under 35 U.S.C. 154(b) by 151 days.

(21) Appl. No.: 10/281,338

(22) Filed: Oct. 25, 2002

(65) Prior Publication Data

US 2003/0080508 A1 May 1, 2003

(30) Foreign Application Priority Data

Oct. 25, 2001 (CA) ..... 2360138

(51) Int. Cl.[7] ..... A63B 71/00
(52) U.S. Cl. ..... 273/139; 283/903
(58) Field of Search ..... 273/139, 269; 283/901, 903

(56) References Cited

U.S. PATENT DOCUMENTS

| | | | | |
|---|---|---|---|---|
| 4,099,721 A | | 7/1978 | Logander | 273/139 |
| 4,147,361 A | | 4/1979 | Imatt | 273/271 |
| 4,740,016 A | | 4/1988 | Konecny et al. | 283/903 |
| 4,943,090 A | | 7/1990 | Fienberg | 273/139 |
| 5,046,737 A | | 9/1991 | Fienberg | 273/139 |
| 5,106,089 A | | 4/1992 | Wood | 273/139 |
| 5,116,049 A | | 5/1992 | Sludikoff et al. | 372/139 |
| 5,232,221 A | | 8/1993 | Sludikoff et al. | 273/139 |
| 5,407,200 A | * | 4/1995 | Zalabak | 273/139 |
| 5,542,710 A | * | 8/1996 | Silverschotz et al. | 283/94 |
| 5,997,401 A | | 12/1999 | Crawford | 463/20 |
| 6,237,913 B1 | * | 5/2001 | Kamille | 273/139 |
| 6,588,747 B1 | * | 7/2003 | Seelig | 273/138.1 |
| 2003/0173739 A1 | * | 9/2003 | Stewart | 273/269 |

FOREIGN PATENT DOCUMENTS

| | | | |
|---|---|---|---|
| DE | 19823200161 | 7/1983 | G07C/15/00 |
| EP | 0874337 A1 | 10/1998 | G07F/17/32 |
| GB | 2056737 A | 3/1981 | G07F/17/34 |
| GB | 2120107 A | 11/1983 | B42D/15/00 |
| GB | 2185413 A | 7/1987 | A63F/3/06 |
| WO | WO 9852661 | 11/1998 | A63F/3/06 |
| WO | WO 9956251 | 11/1999 | G07C/15/00 |

OTHER PUBLICATIONS

Hardee's Chicken Or The Egg (a lottery ticket), Hardee's Food Systems, Inc., 1991.*

* cited by examiner

*Primary Examiner*—William M. Pierce
(74) *Attorney, Agent, or Firm*—Bourque & Assoc, P.A.

(57) ABSTRACT

The present invention provides a lottery type game system, method and ticket, wherein the winning of a game is determined by the assignment of game images to a predetermined number of consecutive positions along a linear array. The value of the prize is determined by the precise position along the linear array at which this predetermined number of game images are assigned. The assignment of the position of a game image can be established by: a) matching a game image associated with a particular gaming piece with an identical image located at a predetermined position along the linear array; or b) receiving a game piece upon which both the game image and the assigned position of the game image along the array is indicated.

18 Claims, 3 Drawing Sheets

WINNING SCHEME FOR A LOTTERY TYPE GAME

FIELD OF THE INVENTION

The present invention pertains to the field of lottery games and more particularly to a winning scheme for use with lottery games.

BACKGROUND

Lottery games have evolved from the original passive draw-type lottery to instant winning games to lotto jackpot type games. The passive draw-type game includes the purchase of a pre-numbered ticket. These tickets were generally sold in ascending numerical order and after a certain period of time the winning number, corresponding to a number on one of the tickets sold, is selected and the prize is awarded to the holder of the ticket bearing:the selected winning number.

Instant winning games generally include a ticket with a scratch-off film where removal of the film reveals a selection of items randomly arranged and subsequently matched according to a predetermined winning scheme. This winning scheme could be based on, for example, a common game like poker, wherein the strength of the poker hand exposed on the ticket determines the prize won. The winning scheme may also be based on the matching of three identical images, for example.

The jackpot lotto game is generally played by randomly picking six numbers within a predetermined set of numbers such as from 1 to 49. These six numbers may be selected by a computer or may be selected by the player and validated by a lottery operator. Generally, with the long odds of winning the game, no particular ordering of numbers is required by the operator for a winning scenario. A winning number set is typically randomly selected from a mixing machine containing balls numbered from, for example, 1 to 49, by the lottery operator. In order to determine if the ticket wins a prize, the player simply checks the ticket to see if the number set on the ticket matches the number set drawn by the lottery operator.

Among those lottery type games wherein some ordering of numbers may be required for a winning scenario, U.S. Pat. No. 5,116,049 discloses a lottery game, which is played by initially selecting a plurality of multiple digit rows of numbers, wherein each row is offset from the preceding row, when imprinted on the ticket. A player will win if they can match at least some numbers from a drawn set of numbers, to numbers consecutively displayed in a row or column on a ticket, wherein matching all of the numbers across produces a jackpot winner. Matching some of the numbers either across or down also produces a prize-winning ticket. The winning scheme for this lottery game is determined by the number of consecutive digits matched on the ticket and is not dependent on the location of the matched digits in a particular row or column.

This background information is provided for the purpose of making known information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a winning scheme for a lottery type game. In accordance with one aspect of the present invention, there is provided a lottery game system comprising: a linear array having a plurality of positions; and at least two game images wherein said game images are assigned to positions along said linear array; wherein the winning of a game is determined by the assignment of game images to a predetermined number of consecutive positions at a precise location along said array and wherein a prize associated with the winning of the game is determined by the precise location along the array at which this predetermined number of game images are assigned.

In accordance with another aspect of the invention, there is provided a method of playing a lottery type game, said method comprising the steps of: a) selecting or generating a linear array having a plurality of positions; b) receiving at least two game images; c) assigning game images received in step (b) to positions along said linear array; d) determining the winning of the game; and e) awarding a prize; wherein the winning of the game is determined by the assignment of game images to a predetermined number of consecutive positions at a precise location along said array and wherein the prize associated with the winning of the game is determined by the precise location along the array at which this predetermined number of game images are assigned.

In accordance with another aspect of the invention, there is provided a ticket for playing a lottery type game, said ticket comprising: a substrate having a front; said front having indica thereon in the form of an array comprising multiple positions, wherein an array image is imprinted at each position along said array; said front further having indica thereon in the form of game images, wherein said game images are concealed by a covering that can be removed by a participant so as to gain sight of the game images, wherein a predetermined number of game images are matched with consecutive identical array images such that a prize of a particular value is won, wherein said particular value of the prize is dependent on the position of the consecutive matched array images along said array.

The present invention provides a lottery game system, wherein the winning of a game is determined by the assignment of game images to a predetermined number of consecutive positions along a linear array, and wherein the value of the prize is determined by the precise position along the linear array at which this predetermined number of game images are assigned. The assignment of the position of a game image can be established by: a) matching a game image associated with a particular gaming piece with an identical image located at a predetermined position along the linear array; or b) receiving a game piece upon which both the game image and the assigned position of the game image along the array is indicated.

BRIEF DESCRIPTION OF THE FIGURES

These and other features and advantages of the present invention will be better understood by reading the following detailed description, taken together with the drawings wherein.

DETAILED DESCRIPTION OF THE INVENTION

Definitions

The term "linear array" or "array" is used to describe a row or column matrix which defines the game format according to the present invention. A linear array may not be illustrated as a "linear" collection of cells, for example, the cells may be illustrated in a curvilinear format. However, each cell represents one position along the array, with this position within the array being determined based upon the sequence in which the cells are displayed.

The term "image" is used to describe any distinguishable representation, which can be used during play of a game, for example, but not limited to, a picture, letter or number.

The term "array image" is used to describe the image(s) which are identified at one or more positions along the array.

The term "game image" is used to describe the image(s) selected or received during the play of a game.

The term "position" is used to describe a specific cell within an array.

The term "game piece" is used to describe any form of playing piece, for example a card, token, or any other medium, upon which a game image can be indicated, wherein said game piece is selected or received during play of a game.

The term "value" is used to describe the prize(s) that may be won if a required consecutive sequence of a predetermined number of array images is realised.

The term "predetermined number" is used to define the number of games images required to be matched with consecutive array images in order to win a prize. The "predetermined number" can be any assigned value, for example, 3, 4, 5, 6 or 10.

The term "winning scheme" is used to define the sequence of consecutive images required to win a prize of a particular value.

Unless defined otherwise, all technical and scientific terms used herein have the same meaning as commonly understood by one of ordinary skill in the art to which this invention belongs.

The present invention provides a lottery game system, wherein the winning of a game is determined by the assignment of game images to a predetermined number of consecutive positions along a linear array, and wherein the value of the prize is determined by the precise position along the linear array at which this predetermined number of game images are assigned. The assignment of the position of a game image can be established by: a) matching a game image associated with a particular gaming piece with an identical image located at a predetermined position along the linear array; or b) receiving a game piece upon which both the game image and the assigned position of the game image is indicated.

Figure 1:
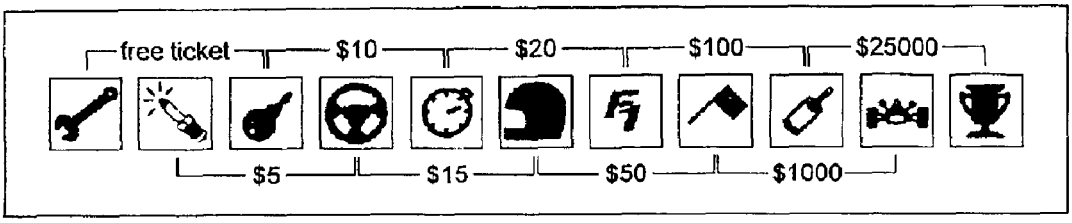
FIG. 1 provides a schematic of one embodiment of the present invention, wherein the winning scheme is a 1×11 array and the cells of the array contain images related to auto racing.

The invention will be further described with reference to the figures, which are understood to be merely illustrative of the invention or to demonstrate preferred embodiments. FIG. 1 provides a schematic of one embodiment of the present invention, wherein the winning scheme is represented by a 1×11 array with the positions of the array being assigned array images related to auto racing. In this embodiment, a prize can be won when a player matches three consecutive array images along the array with identical game images. The value of the prize can be determined by the position of the three consecutive matched array images along said array. For example, a player may win $10 for matching the "key", "steering wheel" and "chronometer" during the play of a game or a player may win $1000 for matching the "flag", "champagne bottle" and "racing car". In this particular example, the further to the right along the array, that the three consecutive matched array images are positioned, the greater the value of the prize.

With further reference to FIG. 1, each position or cell along an array is associated with a number of potential prizes, thus during play of a game, a player's interest and enjoyment of a game may be enhanced due to the interconnection or interlacing of potential prizes. For example in FIG. 1, the "champagne bottle" is associated with prizes of $100, $1000 and $25000. Thus, if the champagne bottle is the first image assigned during play of a game, a player may speculate with regard to the possible winning combinations, which in turn may enhance the interest and enjoyment of the player during play of the game.

In one embodiment of the present invention, the array images and the game images, can be associated with a particular theme. These images can be associated with, for example, auto racing, football, endangered animals, etc. A thematic type of lottery game may be associated with a particular event or promotion, for example an F1 race. Furthermore, a thematic lottery game may also be used as a marketing or promotional means depending upon the theme chosen for the specific lottery game.

Figure 2A:
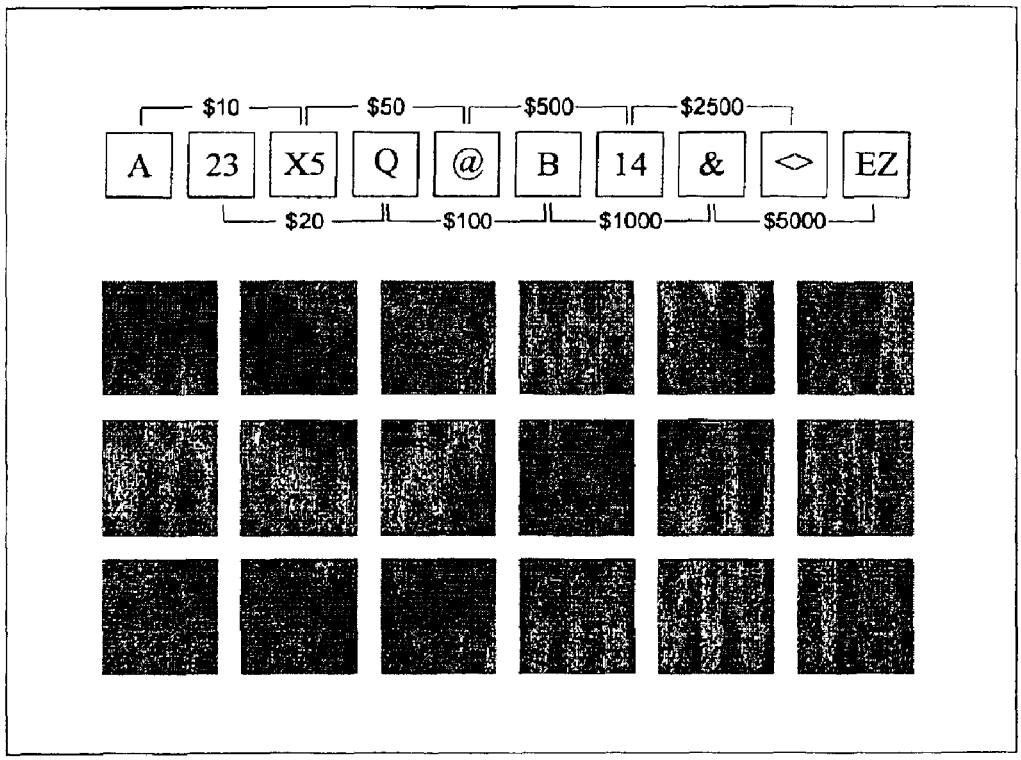
FIGS. 2A and 2B provide a schematic of one embodiment of the present invention, wherein the winning scheme is incorporated into a "scratch and win" type lottery ticket.
Figure 2B:
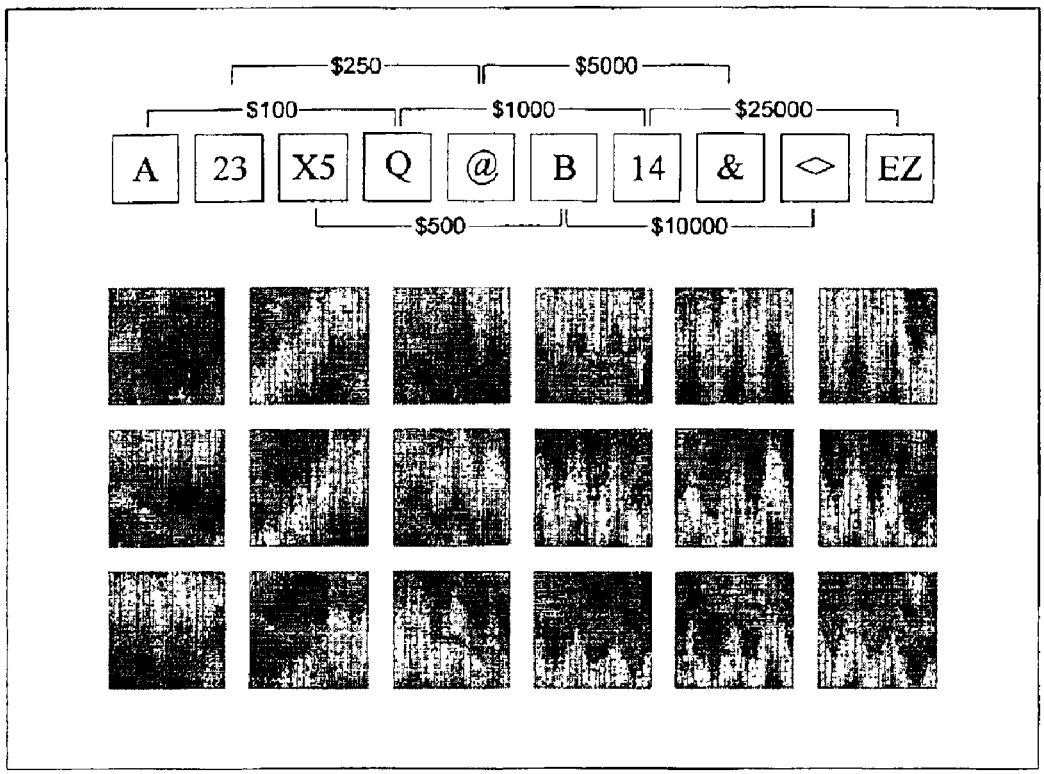

In one embodiment of the present invention and with reference to FIGS. 2A and 2B, the linear array associated with the winning scheme of the present invention can be used in association with an "instant scratch and win" lottery type game. For example, a player can buy a printed ticket, with the linear array associated, with the winning scheme printed across the top of the ticket, as shown in FIGS. 2A and 2B. The depicted linear array contains a number of array images while the position and sequence of said array images indicate the prizes that may be won. At a further location on the ticket, a number of game images can be imprinted with the identity of these game images being concealed from the player by a removable coating, for example. These concealed game images may match some of the array images contained in the linear array. During the course of play, a player can reveal a pre-established number of concealed game images or all of the game images, for example and subsequently attempt to match game images with the array images in order to determine if a prize may be won. As shown in FIG. 2A, the player must match three consecutive array images in order to win a prize. Furthermore, as illustrated in FIG. 2B, four consecutive array images must be matched in order to win a prize. As would be known to a worker skilled, the number of matched consecutive array images required to win a prize can vary and be predetermined for a particular game. The value of the prize is associated with the position of the predetermined number of consecutive matched array images along the array. In these particular examples, the predetermined number of consecutive array images located at the far right of the array are associated with the largest prize, however it may alternately be associated with the consecutive array images at the far left or elsewhere.

In a further embodiment, an array associated with the winning scheme of the present invention can be used in conjunction with gaming machines such as slot machines containing rotating wheels, video lottery machines and other electronic gaming devices. In addition, the winning scheme can be applicable to many other electronic supports including CD, internet, interactive television and instant lottery. For example, a particular array defining a winning scheme may be associated with a particular gaming machine or a player may be able to select an array of preferred images as the winning scheme. The selection of the winning scheme occurs prior to the play of a game. The gaming machine subsequently determines the game images for use in the game session and displays these selected images to the player. In one embodiment, the selection of a particular winning scheme according to the present invention, may also change the potential prizes that may be won. The player may proceed to attempt to match the selected game images with the array images contained in the linear array or the machine may attempt to perform this matching procedure. If the game images selected by the gaming machine match the predetermined number of consecutive array images, the player may win a prize. The value of the prize won is determined by the position of the predetermined number of consecutive matched array images along the linear array.

In a further embodiment of the present invention, and with further reference to FIG. 1, a winning scheme according to the present invention can be used in conjunction with player participation in a car race, for example a go-kart race or a race car video game. At the completion of each lap of the race track, a player may receive a gaming piece upon which a game image is indicated, or said image can be automatically accorded to a player by an electronic means. After the completion of the final lap, the player can proceed to match the game images received during the race with the array images indicated on the linear array associated with the game. If three consecutive array images are matched with corresponding game images, the player may win a prize. The value of the prize is determined by the position along the array of the three consecutive matched array images. For example, if the player receives gaming pieces having a "chronometer", "helmet" and "F1" images, the player wins $20.

Figure 3A:
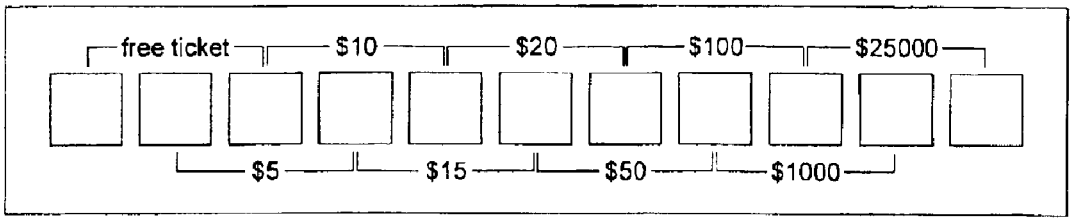
FIGS. 3A–3C provide a schematic of one embodiment of the present invention, wherein initially images are not associated with any of the cells in the linear array. During play of a game, game images are assigned position(s) along the linear array.
Figure 3B:
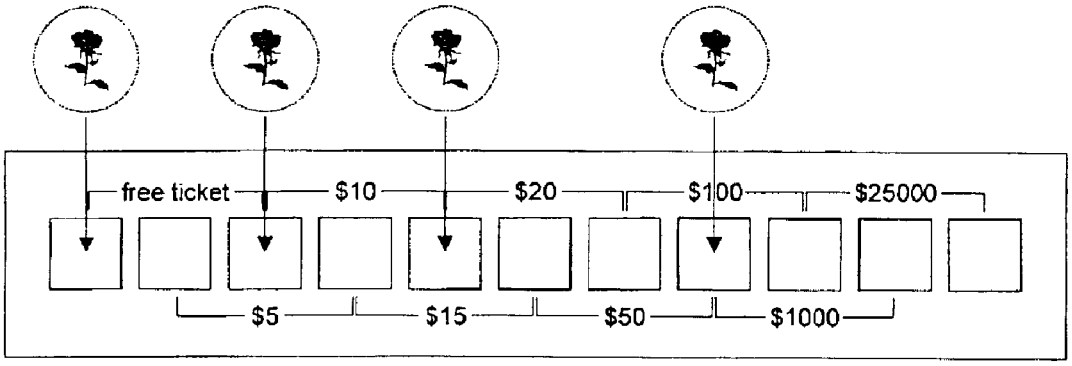
Figure 3C:
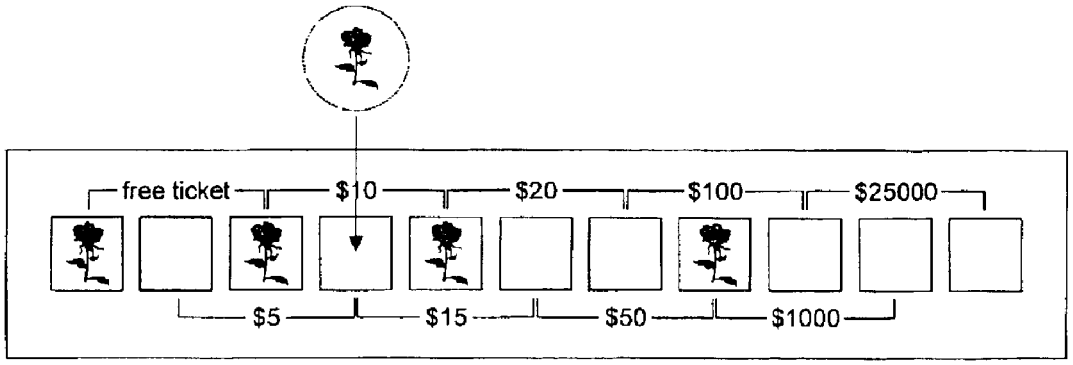

In one embodiment of the present invention and with reference to FIGS. 3A–3C, the winning scheme of the present invention can be incorporated with a "match 3" type game. In this embodiment, the linear array determining the winning scheme does not contain any array images at the commencement of the game, as illustrated in FIG. 3A. During play of the game a player receives images which are assigned to particular positions along the array. With reference to FIG. 3B, four flower images are collected by a player and these images are assigned positions 1, 3, 5 and 8 along the linear array. In FIG. 3C, the final flower image is assigned position 4 and therefore the player wins $10. In contrast and with further reference to FIG. 3C, the player would win a free ticket if the final flower image was assigned position 2 or the player would not win a prize if the final flower is assigned to position 11. The value of the prize is determined by the position of the three consecutive images along the array. It is understood that this "match 3" type game may also be conceived as requiring any predetermined number consecutive array images to be matched in order to win a prize, for example, the predetermined number can be 4, 5, 6 or 10.

In a further embodiment, the winning scheme of the present invention can be used to create a bonus mode in relation to a gaming terminal or a video lottery terminal, for example.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

Modification and substitutions by one of ordinary skill in the art are considered to be within the scope of the present invention, which is not to be limited except by the following claims.

I claim:

1. A lottery game system comprising a lottery game including:

(a) a linear array having a plurality of positions and one or more precise locations, each precise location including a predetermined number of consecutive positions of the plurality of positions, each precise location being associated with a prize; and (b) at least two game images, each of said game images being assigned to one of the plurality of positions along said linear array during play of the game;

wherein a winning event occurs when game images are assigned to the predetermined number of consecutive positions of one of the precise locations, thereby winning the prize associated with that precise location.

2. The lottery game system according to claim 1, wherein said assignment of the position of a game image is established by receiving a game piece upon which a game image and an assigned position of the game image along the linear array is indicated.

3. The lottery game system according to claim 1, wherein the game images are associated with a particular theme.

4. The lottery game system according to claim 1, wherein the predetermined number is selected from the group comprising 3, 4 and 5.

5. A method of playing a lottery type game, said method comprising the steps of:

(a) initiating play of the lottery game by providing to a player a linear array having a plurality of positions;

(b) providing to the player at least two game images;

(c) assigning by the player each of said game images provided in step (b) to one of the plurality of positions along said linear array;

(d) determining if a winning event has occurred, said winning event being determined by evaluating if each position associated with a precise location has game images assigned thereto, the precise location including a predetermined number of consecutive positions of the plurality of positions, the precise location having a prize associated therewith; and (e) awarding the prize to the player, if each of the predetermined number of consecutive positions have game images assigned thereto.

6. The method of playing a lottery type game according to claim 5, wherein said step of assigning is established by matching the game image with an identical image located at a predetermined position along the linear array.

7. The method of playing a lottery type game according to claim 5, wherein said step of assigning is established by receiving a game piece upon which a particular game image and an assigned position of the particular game image along the linear array is indicated.

8. The method of playing a lottery type game according to claim 5, wherein the game images are associated with a particular theme.

9. The method of playing a lottery type game according to claim 5, wherein the predetermined number is selected from the group comprising 3, 4 and 5.

10. A ticket for playing a lottery type game, said ticket comprising:

(a) a substrate having a front;

(b) said front having indicia thereon in the form of an array comprising multiple positions, wherein an array image is imprinted at each position along said array, said front having indicia thereon indicating one or more prizes, each prize associated with a predetermined number of consecutive positions at a predetermined location along the array;

(c) said front further having indicia thereon in the form of game images, wherein said game images are concealed by a covering that can be removed by a participant so as to gain sight of the game images, wherein game images are matched with identical array images during play of the lottery type game.

11. The ticket for playing a lottery type game according to claim 10, wherein the array images and game images are associated with a particular theme.

12. The ticket for playing a lottery type game according to claim 10, wherein the predetermined number is selected from the group comprising 3, 4 and 5.

13. A lottery game system comprising a lottery game including;

a) a linear array having a plurality of positions and one or more precise locations, each precise location including a predetermined number of consecutive positions of the plurality of positions, each precise location being associated with a prize; and b) at least two game images, each of said game images being assigned to one of the plurality of positions along said linear array during play of the lottery game by matching the game image with an identical image located at one of the plurality of positions;

wherein a winning event occurs when game images are assigned to the predetermined number of consecutive positions of one of the precise locations, thereby winning the prize associated with that precise location.

14. The lottery game system according to claim 13 wherein the game images are associated with a particular theme.

15. The lottery game system according to claim 13 wherein the predetermined number is selected from the group comprising 3, 4 and 5.

16. A lottery game system comprising a lottery game including:

a) a linear array having a plurality of positions and one or more precise locations, each precise location including a predetermined number of consecutive positions of the plurality of positions, each precise location being associated with a prize; and b) at least two game images, each of said game images having a specific position selected from the plurality of positions associated therewith prior to play of the game, each game image being assigned to its respective specific position during play of the lottery game, wherein a winning event occurs when game images are assigned to the predetermined number of consecutive positions of one of the precise locations, thereby winning the prize associated with that precise location.

17. The lottery game system according to claim 16 wherein the game images are associated with a particular theme.

18. The lottery game system according to claim 16 wherein the predetermined number is selected from the group comprising 3, 4 and 5.

* * * * *